US006010360A

United States Patent [19]

Ohai

[11] Patent Number: 6,010,360

[45] Date of Patent: Jan. 4, 2000

[54] LAMP SOCKET ASSEMBLY FOR USE WITH HEAT LAMPS

[76] Inventor: Reynolds Ohai, 13450 Monte Vista, Chino, Calif. 91710

[21] Appl. No.: 09/046,199

[22] Filed: Mar. 23, 1998

[51] Int. Cl.[7] ..... H01R 16/60

[52] U.S. Cl. ..... 439/543; 439/603

[58] Field of Search ..... 439/543, 558, 439/605, 601, 602, 603, 702, 703, 704, 611, 613, 615, 802

[56] References Cited

U.S. PATENT DOCUMENTS 1,661,689 3/1928 Both ..... 439/602

1,703,279 2/1929 Meuer ..... 439/534

4,294,503 10/1981 Lieberman ..... 339/119

*Primary Examiner*—Lincoln Donovan

*Attorney, Agent, or Firm*—Edgar W. Averill, Jr.

[57] ABSTRACT

A lamp socket assembly having a groove in the cap which matches a ridge in the cover to assist in tightening the assembly. A typical heat lamp assembly has a husk holding the socket which holds the heat lamp and a cap is affixed to the top of the husk. The cap has a groove cut in it which matches a ridge formed on the cover member which is held over the husk and the heat lamp. Thus, one can tighten the husk within the cover by simply holding the stem and turning the cover. The cover, in turn, turns the cap and the husk to tighten the flange against the cover.

6 Claims, 2 Drawing Sheets

Fig. 5
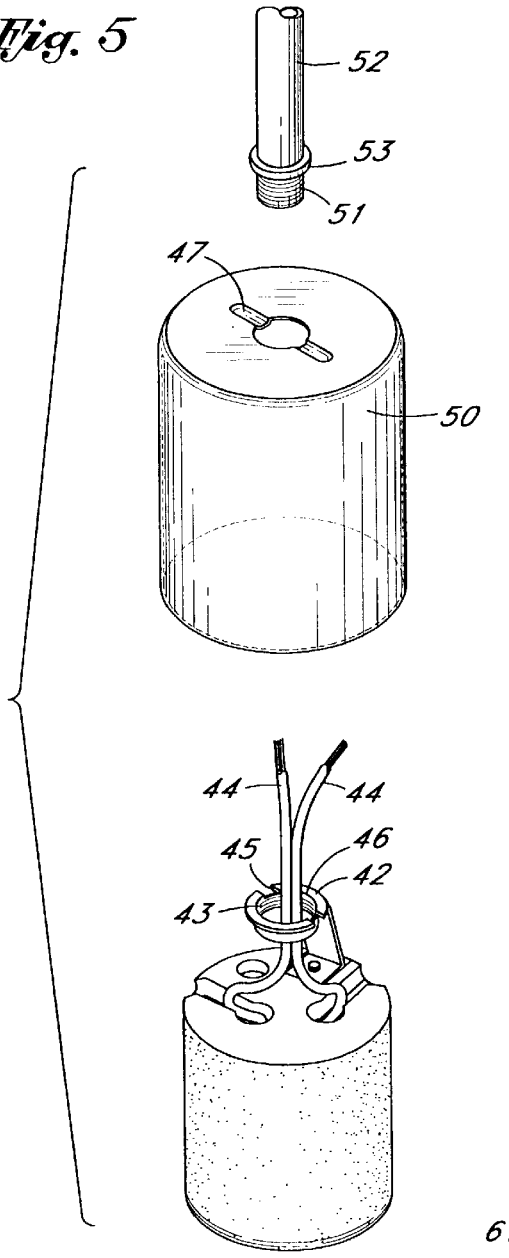
Fig. 7
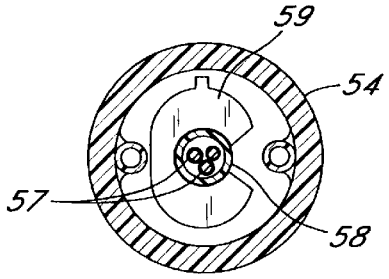
Fig. 6
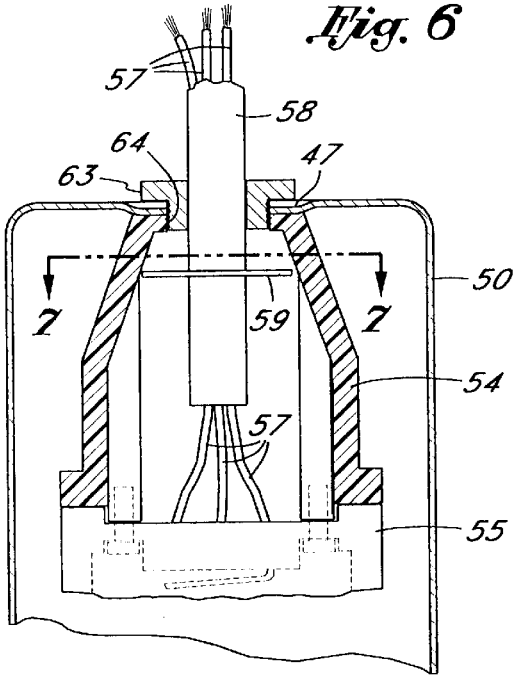
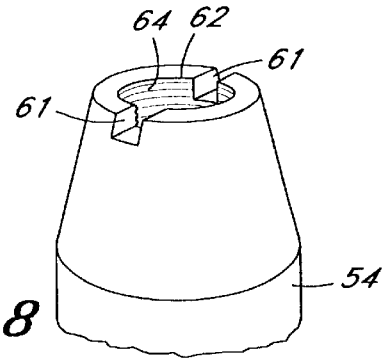
Fig. 8

LAMP SOCKET ASSEMBLY FOR USE WITH HEAT LAMPS

BACKGROUND OF THE INVENTION

The field of the invention is lighting fixtures and the invention relates more particularly to lighting fixtures which are suspended from a threaded nipple and have a husk which is covered with a cup or cover member.

Many fixtures are designed to hang downwardly from a stem or from a flexible cord and have a socket assembly which holds a heat lamp or other lamp which gives off a significant amount of heat. As the lamp is turned on and off over an extended period of time, the cycles of expansion and contraction caused by the heat of the lamp often loosen the nipple which is screwed into the top of the cap of the socket assembly. This loosening is often sufficient over time so that the nipple comes completely unscrewed from the cap. This results in the fixture being supported by the electrical cord which is not safe. A cover or cup is typically held over the nipple and has a sharp inner surface which then can directly contact the insulated wires causing the possibility of an electrical short. Applicant's U.S. Pat. No. 5,626,498 shows a cap and cover assembly, including a groove and ridge, which permits the tightening of a nipple into the cap without having to touch the insulative husk. The cap shown in this patent, however, must be specially fabricated and the economy of utilizing a high production conventional cap is not possible.

SUMMARY OF THE INVENTION

It is an object of the present invention to provide a heat lamp assembly which has a socket assembly with a groove in the top which matches a ridge on a cap covering and held against the socket assembly so that one can tighten the socket assembly against the stem by holding the cover and the stem and turning one with respect to the other.

The present invention is for a lamp socket assembly of the type having an insulative husk having a cylindrical outer surface, a top surface and an internal conductive lamp holding shell. At least two electrical leads extend out of the top of the husk and the improvement of the present invention comprises a cap affixed above the top surface of the insulative husk and the cap has a groove in its upper surface. The cap also has a conventional threaded central passageway for the two leads and for the affixing of a nipple. A cover member has a top portion with a matching ridge extending below the bottom surface thereof which matching ridge matches the groove of the cap. The cover member extends downwardly over the husk and also has a central opening for the passage of the nipple and the cover member has an upper surface surrounding the central opening. A nipple has a hollow central passageway and is threaded into the threaded central passageway of the cap. The nipple extends through the central opening of the cover member and a flange is held by the nipple and screwed against the upper surface of the cover member.

When the cover member is placed over the cap, the groove of the cap is matched against the ridge of the cover member and the flange abuts the upper surface of the cover member holding the ridge in the groove and permitting the flange to be tightened against the cover member by tightening the flange while holding the cover member. The cover member, in turn, holds the cap and husk.

Preferably, the groove is simply cut in the top surface of a threaded extension of the cap or can be formed in the top surface of a hickey held to the insulative husk. Alternatively, the groove may be cut in an insulative splice box held to the top of the husk. A further improvement is the provision of a hollow cylindrical member having an inner opening larger than the nipple and an external surface small enough to fit within the cover member. The hollow cylindrical member has an upper surface with a groove and a lower surface with a ridge. The ridge matches the groove of the cap and the groove in the upper surface mates with the matching ridge of the cover member. The extension permits the positioning of the cap with respect to the cover member. Preferably, the groove on the upper surface is aligned 90° from the matching ridge on the lower surface.

BRIEF DESCRIPTION OF THE DRAWINGS

FIG. 5 is an exploded view of an alternate embodiment of the lamp socket assembly of FIG. 1.

FIG. 6 is a cross-sectional view of an alternative embodiment of the lamp socket assembly of FIG. 1.

FIG. 7 is a cross-sectional view taken along line 7—7 of FIG. 6.

FIG. 8 is a perspective view showing the top of the insulative splice box of the lamp socket assembly of FIG. 6.

DESCRIPTION OF THE PREFERRED EMBODIMENTS

Figure 1:
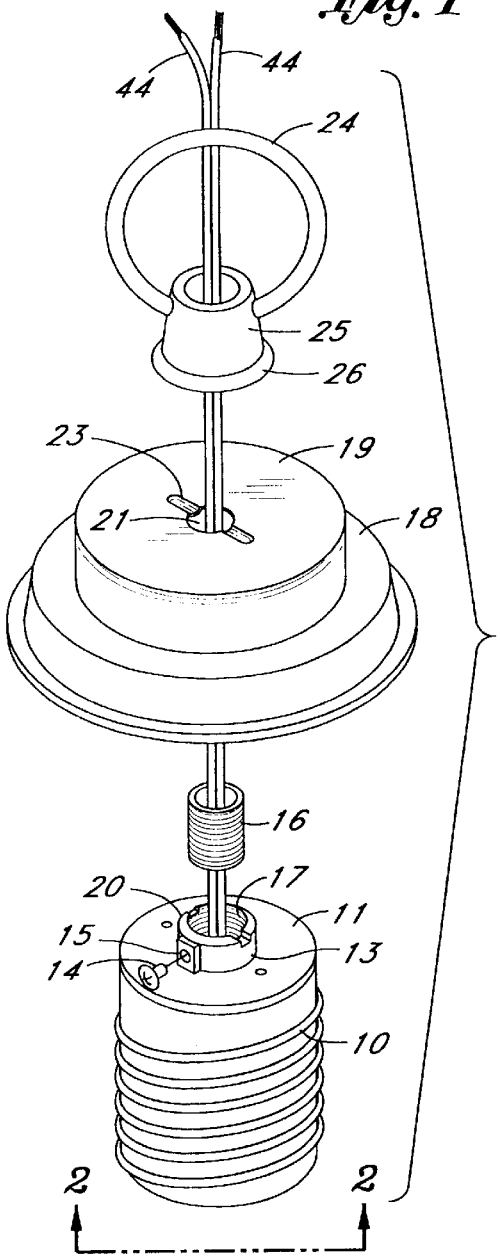
FIG. 1 is an exploded perspective view of the improved lamp socket assembly of the present invention.
Figure 2:
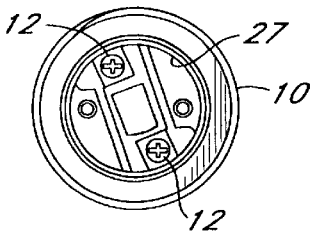
FIG. 2 is a view taken along line 2—2 of FIG. 1.

A lamp socket assembly is shown in exploded perspective view in FIG. 1. The lamp socket assembly has an insulative husk 10 having a conductive cap 11 held to the top thereof. Cap 11 is held to husk 10 by a pair of screws 12 shown in FIG. 2 which is the conventional manner of holding a cap to a husk. An internally threaded extension 13 extends upwardly from cap 11 and has a set screw 14 held in a threaded opening 15 which is also conventional. A nipple 16 is screwed into the threaded opening 17 and is held in place by the tightening of screw 14 against its outer surface. A cup 18 is typically decorative and often a reflective member is placed over cap 11 so that its top portion 19 abuts the upper surface 20 of threaded extension 13. A central opening 21 fits around nipple 16 but is smaller than threaded extension 13 so that the cup 18 rests on upper surface 20 of cap 11. A groove 22 is formed in the upper surface 20 of threaded extension 13. A matching ridge 23 fits into groove 22 when the assembly is tightened together so that cup 18 cannot turn with respect to cap 11. A fixture support ring 24 has an internally threaded base 25 with a flange 26 at the bottom thereof. Fixture support ring 24 is screwed onto nipple 16 and flange 26 abuts top portion 19 of cup 18 and forces the matching ridge 23 into groove 22. Thus, to tighten the assembly in the event it becomes loose one merely need hold cup 18 and turn fixture support ring 24 with respect thereto. Since the cap 11 is prevented from turning by the positioning of matching ridge 23 in groove 22, this causes the fixture support ring to tighten against the top portion 19 and against the upper surface 20 of cap 11.

Typically cup 18 extends substantially over husk so that it is not possible to hold husk 10 while turning fixture support ring 24. Also typically when the lamp is in use, the lamp, which is held in threaded base 27, likewise cannot and should not be held to tighten fixture support ring 24 into the assembly. Of course, fixture support ring 24 is often simply a straight or curved stern member with its essential feature being flange 26.

Figure 3:
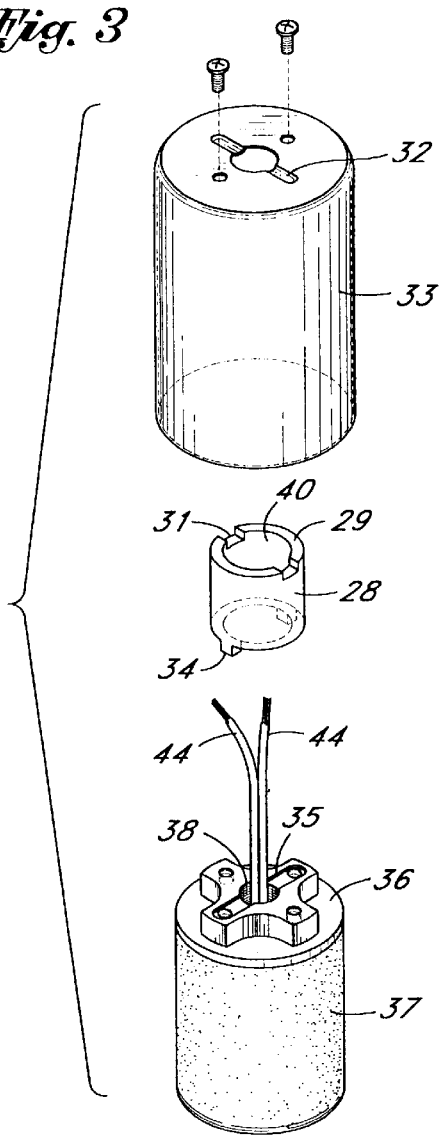
FIG. 3 is an exploded perspective view of the lamp socket assembly of the present invention, further including an extension member.

An extension member 28 is shown in an alternate embodiment of a socket assembly in FIG. 3. Extension 28 in FIG. 3 is a relatively short extension and is a hollow cylindrical member. Extension 28 has an upper surface 29 and a lower surface 30. Upper surface 29 has groove 31 formed in it which matches the matching ridge of cup 33. Lower surface 30 of extension 28 has a pair of matching ridges 34 which fit into elongated groove 35 in cap 36. Cap 36 is held to husk 37 by screws analogous to screws 12 of FIG. 2. Cap 36 has a threaded central passageway 38 into which a stem or other nipple may be inserted.

Figure 4:
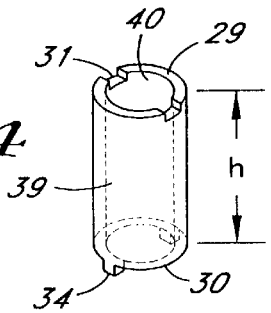
FIG. 4 is a perspective view of an alternate embodiment of the extension member of the lamp socket assembly of FIG. 3.

Short extension 28 raises cup 33 with respect to husk 37 which may be desirable for the particular assembly being used. While short extension 28 raises cup 33 a short distance, a long extension 39 raises the relative distance an amount indicated by "h" in FIG. 4. The inner opening 40 of either extension 28 or extension 39 is larger than a nipple 16 to be used in conjunction therewith so that the nipple extends downwardly through the inner opening 40 so that it may be threaded into threaded central passageway 38.

An alternate embodiment of the lamp socket assembly of the present invention is shown in exploded perspective view in FIG. 5 where husk 41 has a hickey 42 held thereto. Hickey 42 has a threaded opening 43 through which leads 44 extend. A groove 45 is cut or otherwise formed in the top 46 of hickey 42. Groove 45 matches matching ridge 47 of cover member 50. A threaded nipple 51 is formed at the lower end of stem 52 which also includes a flange 53. Thus, when the assembly is put together the matching ridge 47 falls into groove 45 and permits one to tighten stem 52 into hickey 42 by holding cover member 50 and stem 52 and turning one with respect to the other.

An assembly using an insulated splice box is shown in FIGS. 6, 7 and 8. Insulative splice box 54 is held to husk 55 by a pair of screws shown in phantom view and indicated by reference character 56. Three insulated wires 57 extend upwardly from husk 55 and are held within an insulative sheath 58. A stress relief ring 59 abuts the inner surface 60 of splice box 54 and is squeezed against the insulative sheath 58 as shown best in FIG. 7. This, of course, causes the splice box 54 to be physically held by insulative sheath 58 rather than insulated wires 57. This assembly is conventional but a groove 61 is cut in the upper surface 62 of insulative splice box 54. The matching ridge 47 of cover member 50 falls into groove 61 so that when nipple and flange assembly 63 is screwed into the threaded opening of splice box 54 the matching ridge 47 is tightly held in groove 61. Thus, the assembly may be easily tightened by holding cover member 50 and turning nipple and flange assembly 63 with respect to cover member 50.

The result of the groove and matching ridge assembly of the present invention is a far safer lamp socket assembly. For instance, in viewing the assembly of FIG. 1 and particularly when a heat lamp is used therewith, the nipple 16 can work its way out of threaded opening 17 causing the sharp edge of central opening 23 to abut the insulative surface of insulated wires 44. With movement or turning of cup 18, this opening can cut into the insulation and provide an electrical hazard or a short.

The groove may be cut, stamped or otherwise formed in the upper surface with a minimum of additional tooling and the matching ridge 33 may be simply stamped in a conventional member. Thus, the improvement of the present invention can be added to conventional lighting fixtures with a minimum of additional expense.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A lamp socket assembly of the type having an insulative husk having a cylindrical outer surface, a top surface and an internal conductive lamp holding shell and at least two leads connected to the conductive lamp holding shell and extending upwardly from the top surface, wherein the improvement comprises:

a cap affixed above the top surface of the insulative husk, said cap having an internally threaded extension having a groove in an upper surface thereof and said cap having a threaded central passageway for the passage of said at least two leads and for the affixing of a stem;

a cover member having a top portion having a matching ridge extending below a bottom surface thereof matching the groove of said cap, said cover member extending downwardly over said husk and said cover member also having a central opening for the passage of a nipple and the leads therein and said cover member having an upper surface surrounding said central opening;

a nipple having a hollow portion and a threaded end screwed into the threaded central passageway of said cap, said nipple extending through said central opening of said cover member; and a flange held by said nipple against the upper surface of said cover member, whereby when the cover member is placed over the cap, the groove of the cap is matched against the ridge of the cover member and the flange abuts the upper surface of the cover member holding the ridge in the groove and the cover member is prevented from turning with respect to the husk and cap.

2. The socket assembly of claim 1 wherein said groove is formed in a top surface of a threaded extension of a cap.

3. The socket assembly of claim 1 wherein said groove is formed in a top surface of a hickey held to said insulative husk.

4. The socket assembly of claim 1 wherein said groove is formed in a top surface of an insulative splice box held to the top of an insulative husk.

5. The socket assembly of claim 1 further including at least one extension comprising:

a hollow cylindrical member having an inner opening larger than said threaded end of said nipple and an external surface small enough to fit within said cover member, said hollow cylindrical member having an upper surface and a lower surface and said upper surface having a groove and the lower surface having a matching ridge extending below the lower surface, said matching ridge matching the groove of said cap and the groove in the upper surface mating with the matching ridge of said cover member.

6. The socket assembly of claim 5 wherein said groove on the lower surface is aligned ninety degrees from the matching ridge on the lower surface.

* * * * *